US008241060B2

(12) United States Patent
Sykes

(10) Patent No.: US 8,241,060 B2
(45) Date of Patent: Aug. 14, 2012

(54) SNAP-ON COAXIAL CABLE CONNECTOR

(75) Inventor: Michael Timothy Sykes, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/652,096

(22) Filed: Jan. 5, 2010

(65) Prior Publication Data

US 2011/0165789 A1 Jul. 7, 2011

(51) Int. Cl.
*H01R 9/05* (2006.01)

(52) U.S. Cl. ..... 439/578; 439/322; 439/316

(58) Field of Classification Search ..... 439/578, 439/583, 352, 320, 319
See application file for complete search history.

(56) References Cited

U.S. PATENT DOCUMENTS 3,665,371 A * 5/1972 Cripps ..... 439/319
4,068,911 A * 1/1978 Lodato et al. ..... 439/319
4,533,194 A 8/1985 Boichut et al.
4,746,305 A * 5/1988 Nomura ..... 439/319
5,181,861 A 1/1993 Gaver, Jr. et al.
5,316,494 A 5/1994 Flanagan et al.
5,595,499 A 1/1997 Zander et al.
6,361,348 B1 3/2002 Hall et al.
6,450,829 B1 9/2002 Weisz-Margulescu
6,575,786 B1 6/2003 Khemakhem et al.
6,805,583 B2 * 10/2004 Holliday et al. ..... 439/578
7,455,550 B1 * 11/2008 Sykes ..... 439/584
2004/0198089 A1 10/2004 Turck et al.
2010/0233901 A1 * 9/2010 Wild et al. ..... 439/578

* cited by examiner

*Primary Examiner* — Hien Vu

(57) ABSTRACT

A coaxial cable connector includes an elongated body extending in a longitudinal direction between a mating end and a cable end. The coaxial cable connector also includes a center contact held by the body. A locking member is circumferentially disposed around the body at the mating end. The locking member has teeth configured to mechanically engage a threaded area of a mating connector to securely attach the coaxial cable connector to the mating connector. The locking member is slidably coupled to the body such that the locking member moves with respect to the body along the longitudinal direction to enable the teeth to align with the threaded area along the longitudinal direction.

18 Claims, 5 Drawing Sheets

SNAP-ON COAXIAL CABLE CONNECTOR

BACKGROUND OF THE INVENTION

The subject matter herein relates generally to coaxial cable connectors, and more particularly, to methods and features for connecting coaxial cable connectors together.

Coaxial cable connectors are used to join cables together or to join a cable to an electronic component such as a circuit board. The coaxial cable connectors typically include a first mating half in the form of a plug and a second mating half in the form of a jack. Different types of coaxial plugs and jacks are known. For example, one known type of connector system is known as a Type-N connector system that uses threaded connectors to join coaxial cables to one another. Type-N connectors were originally developed to provide a durable, weatherproof, medium-size radio frequency (RF) connector having consistent performance through 11 GHz and were one of the first connectors capable of carrying microwave-frequency signals. An exemplary application for these connectors is the termination of medium to miniature size coaxial cable, including RG-8, RG-58, RG-141, and RG-225. The N connector may follow the MIL-C-39012 standard, defined by the US military, and comes in 50 and 75 ohm versions, the latter of which is used in the cable television industry. RF coaxial connectors are important elements in the cable system in terms of overall system performance.

Conventional Type-N connector systems include two basic components: a plug that utilizes a center pin (i.e., male gender); and a jack that utilizes a center socket (i.e., female gender), to which the plug is connected. Connecting these components to one another involves turning a collar included on the plug to engage threading included on the jack. Turning the collar typically involves the use of a somewhat unwieldy torque wrench. This wrench tightens the collar to a specific, predetermined torque value for ensuring that the ground plane of the connectors has a proper connection. Because the use of the torque wrench is inconvenient, and may damage the plug if the wrench is improperly used, there is an ongoing need for an N connector system that does not require the use of a wrench.

BRIEF DESCRIPTION OF THE INVENTION

In one embodiment, a coaxial cable connector is provided that includes an elongated body extending in a longitudinal direction between a mating end and a cable end. The coaxial cable connector also includes a center contact held by the body. A locking member is circumferentially disposed around the body at the mating end. The locking member has teeth configured to mechanically engage a threaded area of a mating connector to securely attach the coaxial cable connector to the mating connector. The locking member is slidably coupled to the body such that the locking member moves with respect to the body along the longitudinal direction to enable the teeth to align with the threaded area along the longitudinal direction.

Optionally, the locking member may be movable between a retracted position and an advanced position. The locking member may move linearly along the threaded area as the locking member is moved from the retracted position to the advanced position. The center contact may be fixed relative to the body such that the locking member moves axially along the body and the center contact.

In a further embodiment, a coaxial cable connector is provided that includes an elongated body extending in a longitudinal direction between a mating end and a cable end. The coaxial cable connector also includes a center contact held by the body. A locking member is circumferentially disposed around the body at the mating end. The locking member has grasping arms being configured to engage a mating connector, and the locking member is slidably coupled to the body such that the locking member moves with respect to the body in the longitudinal direction to enable the grasping arms to be aligned with the mating connector. A collar is circumferentially disposed around the locking member. The collar is slidably coupled to the locking member for engaging the grasping arms and applying a radial compressive force thereto for moving the grasping arms toward the mating connector.

In a further embodiment, a coaxial cable connector is provided including a center contact defining a signal plane along a contact axis and a body circumferentially disposed around at least a portion of the center contact, where the body defines a ground plane. A locking member is circumferentially disposed around the body and is slidably coupled to the body such that the locking member moves with respect to the body in an axial direction parallel to the contact axis. The locking member is configured to snap-on and engage a threaded area of a mating connector to securely attach the coaxial cable connector to the mating connector. A biasing member is circumferentially disposed around the body and engages the locking member and provides a linear force on the locking member urging the locking member away from the mating connector.

DETAILED DESCRIPTION OF THE INVENTION

Figure 1:
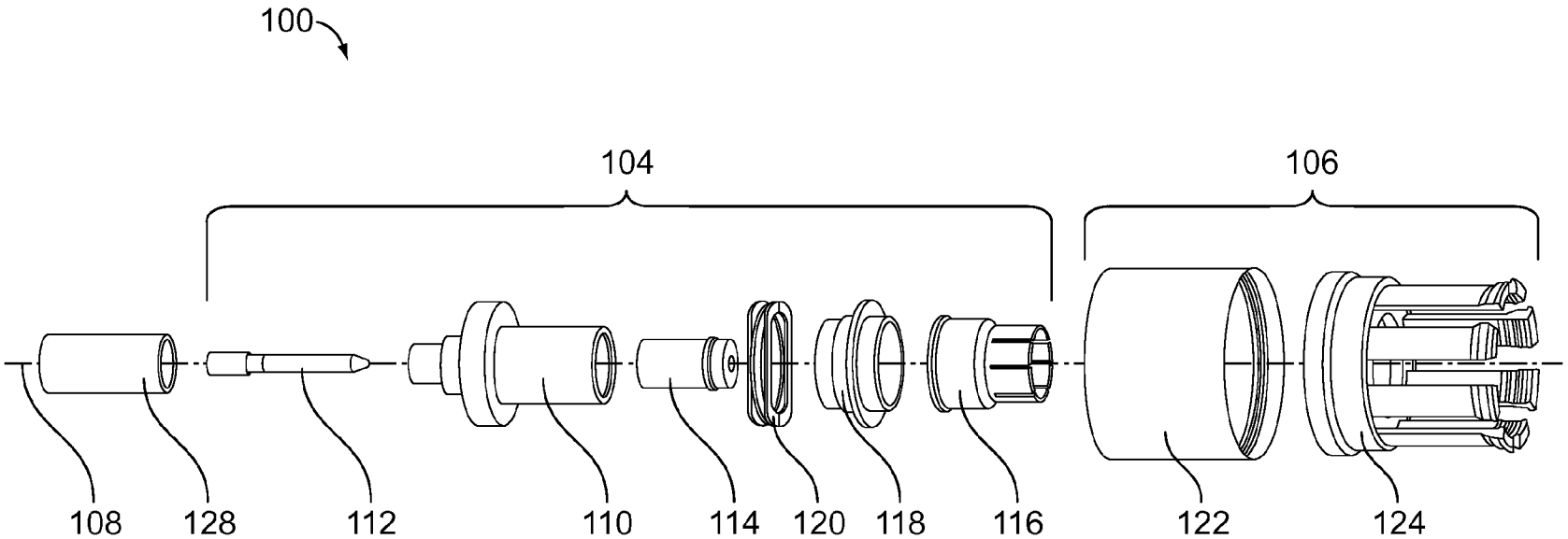
FIG. 1 is an exploded side view of a coaxial cable connector formed in accordance with an exemplary embodiment.

FIG. 1 is an exploded side view of a coaxial cable connector 100 formed in accordance with an exemplary embodiment. The connector 100 is a manual, single motion, snap-on connector for use with a connector system. The connector 100 is configured to be terminated to an end of a coaxial cable (not shown). The connector 100 represents a plug component of a connector system that is configured to mate with a mating connector, such as the jack component 10 (shown in FIG. 3). As such, the connector 100 includes a male type of contact (e.g. a pin contact) and the mating connector includes a female type of contact (e.g. a socket contact). In the illustrated embodiment, the connector 100 constitutes a Type-N radio frequency (RF) connector, however the subject matter herein is not intended to be limited to such connectors. As such, the connector 100 is shown as being one exemplary type of connector having a snap-on arrangement as described herein. Other connector types may include such a snap-on arrangement to interconnect complementary connector components in alternative embodiments.

The connector 100 includes an electrical core 104 and a locking assembly 106 slidably coupled to the electrical core 104. The electrical core 104 and the locking assembly 106 extend longitudinally along a connector axis 108. The electrical core 104 makes an electrical connection with the jack component 10 and the locking assembly 106 makes a mechanical connection with the jack component 10. In an exemplary embodiment, the electrical core 104 has both a signal plane that transmits the signal from the center conductor of the cable, and a ground plane that grounds to a cable shield or cable braid of the cable. The ground plane provides circumferential shielding around the signal plane.

The electrical core 104 comprises a rear body 110, a center pin contact 112, and dielectric material 114 that holds the center pin contact 112 within the rear body 110. The electrical core 104 also comprises a front body 116, a retainer 118, and a biasing member 120 that fit over the rear body 110. The center pin contact 112 forms part of the signal plane. The center pin contact 112 is configured to be electrically connected to a complementary mating contact of the mating connector. The front and rear bodies 116, 110 define an outer contact that circumferentially surrounds the center pin contact 112, and form part of the ground plane. The front and rear bodies 116, 110 are configured to be electrically connected to a corresponding outer contact of the mating connector as well as the cable braid of the cable.

The locking assembly 106 includes a collar 122 and a locking member 124 that fit over the electrical core 104. In an exemplary embodiment, both the collar 122 and the locking member 124 are independently movable with respect to the electrical core 104. For example, the locking member 124 is configured to be slidable along the electrical core 104 in a longitudinal direction that is parallel to the connector axis 108. Similarly, the collar 122 is configured to be slidable along the locking member 124 in a longitudinal direction that is parallel to the connector axis 108. As such, the collar 122 is also slidable with respect to the electrical core 104 in the longitudinal direction. The collar 122 and the locking member 124 cooperate to securely attach the connector 100 to the mating connector. As described in further detail below, the locking assembly 106 is configured to snap-on to a threaded area of the mating connector.

The connector 100 also includes a ferrule 128. The ferrule 128 is provided at the interface of the cable and the connector 100. The ferrule 128 provides strain relief for the interface between the cable and the connector 100. The ferrule 128 may be crimped to the end of the cable to secure the cable to the connector 100.

Figure 2:
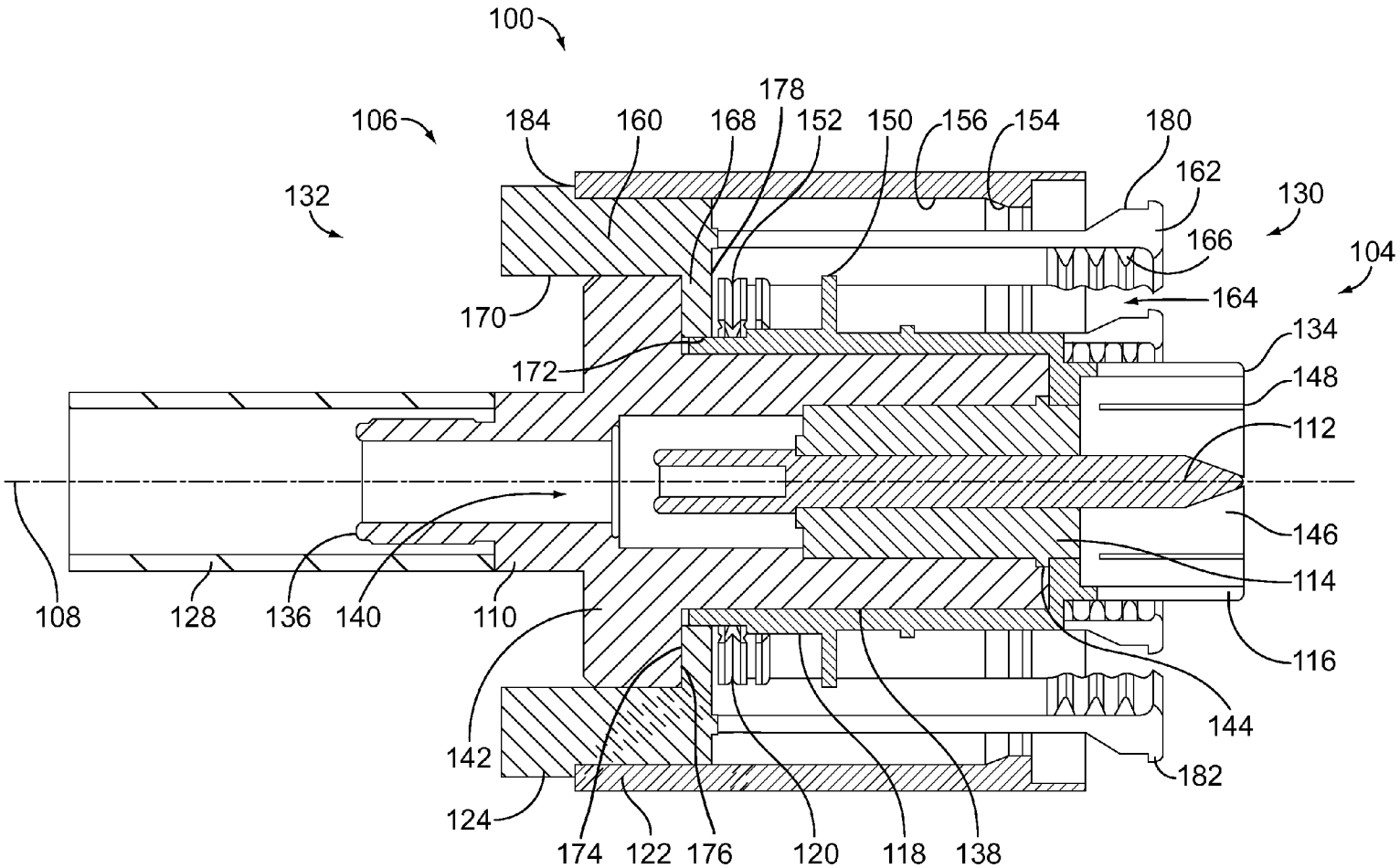
FIG. 2 is a cross-sectional side view of the coaxial cable connector shown in FIG. 1 in an unmated state.
Figure 3:
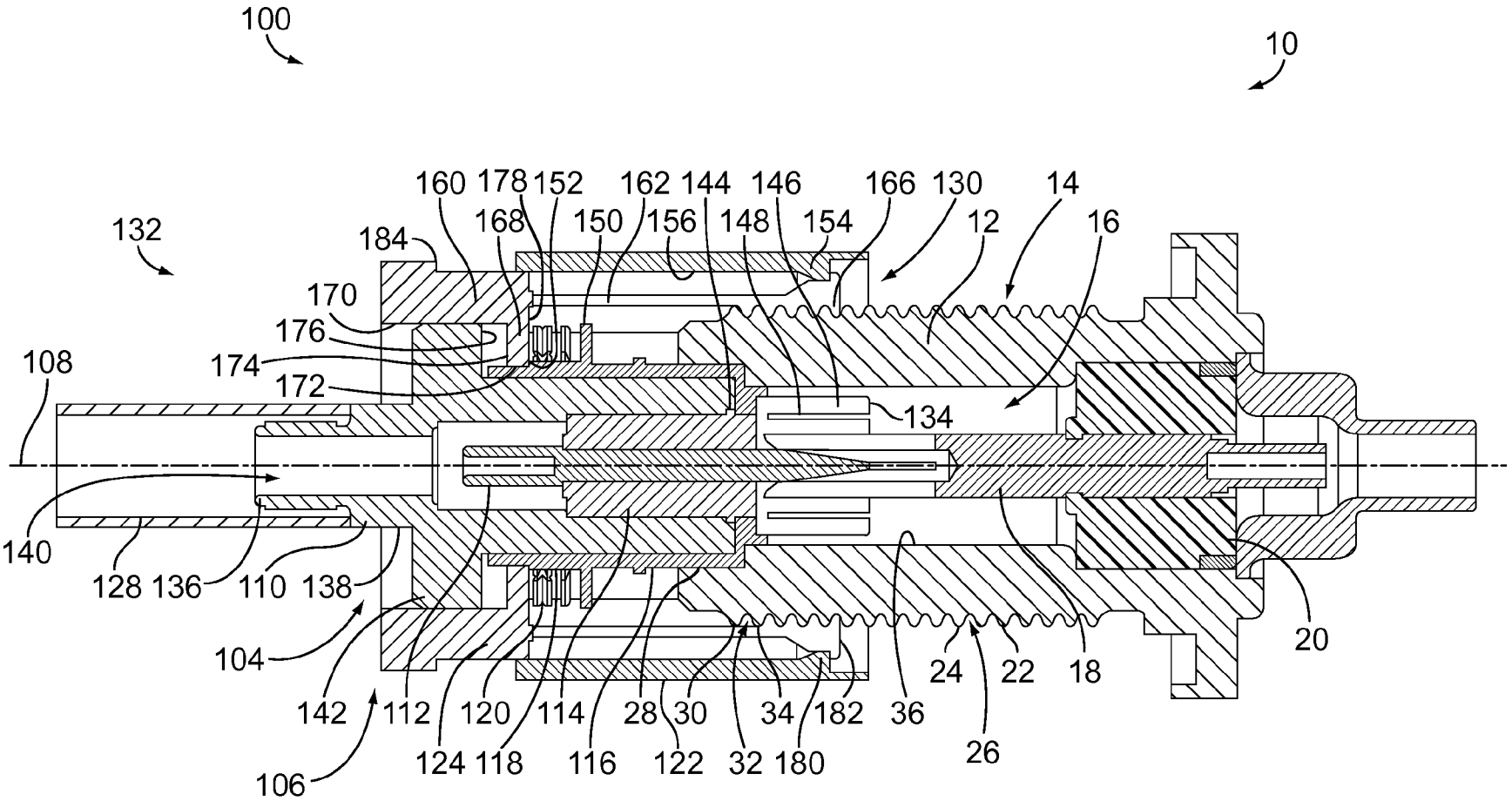
FIG. 3 is a cross-sectional side view of the coaxial cable connector shown in FIG. 1 in a mated state with a coaxial jack connector.

FIG. 2 is a cross-sectional side view of the coaxial cable connector 100 in an unmated state. FIG. 3 is a cross-sectional side view of the coaxial cable connector 100 in a mated state with a coaxial jack connector 10. The jack connector 10 is mated to a front end 130 of the connector 100. A rear end 132 of the connector 100 is arranged opposite to the front end 130 and is configured to be terminated to an end of a coaxial cable. The ferrule 128 surrounds a portion of the rear end 132.

The jack connector 10 includes a body 12 having an outer threaded area 14 and an inner chamber 16, which houses a center socket contact 18. The center socket contact 18 is held by a dielectric material 20. The threaded area 14 includes a plurality of threads 22 having ridges 24 which are separated by valleys 26. The threaded area 14 is positioned proximate to a front end 28 of the body 12. The forward-most thread is referred to as a first thread 30, which is followed by a first valley 32, a second thread 34, and so-on. The inner chamber 16 is defined by a surface 36. During mating of the connector 100 and the jack connector 102, the locking member 124 is snapped onto the threaded area 14, rather than being rotated onto the threaded area 14.

The rear and front bodies 110, 116 cooperate to define a main body of the connector 100. In an alternative embodiment, rather than being two separate body pieces, the main body may be a single unitary piece. The main body is elongated in a longitudinal direction between a mating end 134 and a cable end 136. The jack connector 10 is mated to the mating end 134 and the cable is configured to be terminated to the cable end 136. The mating end 134 is part of the front body 116 and the cable end 136 is part of the rear body 110.

The rear body 110 has a generally cylindrical outer surface 138 and includes a hollow bore 140. The dielectric material 114 and the center pin contact 112 are received within the hollow bore 140. The rear body 110 includes an outer flange 142 that extends radially outward with respect to the connector axis 108. In the illustrated embodiment, the outer flange 142 is positioned proximate to the rear end of the rear body 110. The front body 116 and the retainer 118 are circumferentially disposed around the outer surface 138, forward of the outer flange 142. The retainer 118 is positioned between the outer flange 142 and the front body 116.

When assembled, the center pin contact 112 is held within the rear and front bodies 110, 116 by the dielectric material 114. The dielectric constant of the dielectric material 114, which is typically plastic or a similar material, establishes consistent impedance along the center pin contact 112 and provides a bearing surface for the center pin contact 112. The dielectric material 114 electrically isolates the center pin contact 112 from the rear and front bodies 110, 116. In an exemplary embodiment, the dielectric material 114 includes a lip 144 circumferentially surrounding at least a portion of the dielectric material 114. The lip 144 is captured between the rear and front bodies 110, 116 when assembled to hold the dielectric material 114 in position within the hollow bore 140.

The center pin contact 112 defines the signal path and is typically manufactured from conductive copper or other metals with good conductive properties. The center contact 112 is typically soldered or crimped to the center conductor of the coaxial cable and may be plated with a conductive material such as gold, silver, or nickel. The center pin contact 112 is held by the dielectric material 114 such that a mating portion of the center pin contact 112 is positioned forward of the dielectric material 114 for mating with the mating connector. The mating portion is circumferentially surrounded by a portion of the front body 116. The center pin contact 112 is mated with the center socket contact 18, as shown in FIG. 3.

In an exemplary embodiment, the front body 116 includes a plurality of spring arms 146 that are separated from one another by slits 148. The spring arms 146 are independently movable. As illustrated in FIG. 3, the spring arms 146 engage the jack connector 10 and make electrical contact with the jack connector 10. For example, the spring arms 146 may be received within the inner chamber 16 and engage the surface 36 of the body 12. The front body 116, including the spring arms 146, and/or the rear body 110 may be manufactured from a conductive material such as, but not limited to, phosphor bronze or beryllium copper, and may be plated with a conductive coating that may include gold, silver, nickel, white bronze, and the like.

The spring arms 146 define a portion of the outer contact that defines the ground plane connection between the connector 100 and the jack connector 10. The ground plane is transferred from the front body 116 to the rear body 110 by the direct physical contact between the front and rear bodies 116, 110. At the cable end 136, the rear body 110 is crimped to the cable braid of the coaxial cable and secured with the ferrule 128. Crimping the rear body 110 to the coaxial cable transfers the ground plane from the rear body 110 to the cable braid.

The retainer 118 is positioned between the front body 116 and the outer flange 142. The retainer 118 is loaded onto the rear body 110 over the front end of the rear body 110 prior to loading the front body 116 onto the rear body 110. The biasing member 120 may be loaded onto the rear body 110 with the retainer 118.

The retainer 118 includes a circumferential rim 150 that extends radially outward from the retainer 118. The rim 150 functions to hold the biasing member 120 in place and provides a bearing surface for the biasing member 120. The biasing member 120 is positioned rearward of the rim 150, generally between the rim 150 and the locking member 124. The biasing member 120 is compressed against the rim 150 as the locking member 124 is moved to an advanced position. The biasing member 120 engages the locking member 124 and provides a biasing force on the locking member 124 urging the locking member 124 away from the mating connector. The biasing force may be adequate to ensure electrical contact between the center pin contact 112 and the mating contact of the mating connector. The biasing force may be adequate to ensure mechanical contact between the locking member 124 and the mating connector, such as by biasing the threads of the locking member 124 against corresponding threads on the mating connector.

The retainer 118 includes a rear facing shoulder 152 proximate to the rear end of the retainer 118. The shoulder 152 may be perpendicular to the outer surface of the retainer 118, or alternatively, may be angled with respect to the outer surface, defining a ramped shoulder. The shoulder 152 is positioned between the rim 150 and the rear end of the retainer 118.

The electrical core 104 provides a mounting substrate for the moveable collar 122 and the movable locking member 124. The collar 122 and the locking member 124 are movably coupled to the electrical core 104 and operate to securely attach the connector 100 to the jack connector 10 such that the electrical core 104 is electrically connected to the jack connector 10.

The collar 122 and the locking member 124 are slidable between retracted positions, such as the positions illustrated in FIG. 2, and advanced positions, such as the positions illustrated in FIG. 3. In the retracted positions, the collar 122 and the locking member 124 are positioned generally rearward as compared to the advanced positions. The collar 122 and the locking member 124 are moved to the advanced positions during mating with the jack connector 10. For example, during mating, the collar 122 and locking member 124 slide longitudinally forward along the threaded area 14 to properly align the locking member 124 with the threads 22 of the jack connector 10. Once properly aligned, the locking member engages the threads 22 in a snapping action to make a secure attachment to the jack connector 10.

The collar 122 is a generally cylindrical, hollow component that is circumferentially disposed around the locking member 124. The collar 122 is slidable in a longitudinal direction, generally parallel to the connector axis 108, along the locking member 124. In the illustrated embodiment, the collar 122 includes an embossment 154 that extends radially inward from an inner surface 156 of the collar 122. The embossment 154 is provided proximate to the front end of the collar 122.

The locking member 124 includes a base 160 and a plurality of grasping arms 162 extending forwardly from the base 160. The grasping arms 162 are disposed circumferentially around, and spaced apart from, the outer periphery of the front body 116. As shown in FIG. 3, the body 12 of the jack connector 10 is configured to fit within a receiving space 164 (shown on FIG. 2) between the front body 116 and the grasping arms 162. The grasping arms 162 are resilient and capable of deflecting inward or outward. For example, the grasping arms 162 may be deflected outward to allow the jack connector 10 to pass through the receiving space 164 during mating of the connector 100 and jack connector 10. The grasping arms 162 may be deflected inward toward the jack connector 10 once the jack connector 10 is properly positioned within the receiving space 164. When the grasping arms 162 are deflected inward, the grasping arms 162 may engage the threads 22 of the jack connector 10.

In an exemplary embodiment, the grasping arms 162 include teeth 166 extending radially inward therefrom. The teeth 166 are configured to snap into the valleys 26 of the individual threads 22 of the threaded area 14. In this manner, the locking member 124 defines a snap-on locking assembly that may be mated using the threaded arrangement of the jack connector 10 without having to rotatably assemble the connector 100 and/or jack connector 10 by rotating either the connector 100 or the jack connector 10 multiple times.

During assembly, as the locking member 124 is moved toward the advanced position, the locking member 124 engages and compresses the biasing member 120. The biasing member 120 exerts a biasing force on the locking member 124 in a rearward direction. The biasing force urges the locking member 124 away from the jack connector 10. The biasing force creates tension between the teeth 166 and the threads 22 to maintain a secure fit between the locking member 124 and the jack connector 10.

The locking member 124 includes an inner flange 168 extending radially inward from an inner surface 170 of the base 160. The inner flange 168 may be positioned proximate to a front of the base 160. An inner perimeter 172 of the inner flange 168 engages or approximately engages the outer surface of the retainer 118. The inner flange 168 is circumferentially disposed around the retainer 118. The inner perimeter 172 slides along the retainer 118 as the locking member 124 is moved from the retracted position to the advanced position, and vice versa. As such, during mating with the jack connector 10, the locking member 124 is moved relative to the rear and front bodies 110, 116 as well as relative to the center contact 112, which is held in place with respect to both the rear and front bodies 110, 116 by the dielectric material 114.

The range of motion of the locking member 124 with respect to the electrical core 104 is limited by the shoulder 152 and by the outer flange 142 of the rear body 110. Alternatively, other features may be used to control the range of motion of the locking member 124. In the retracted position, a rear facing surface 174 of the inner flange 168 engages, or approximately engages, a forward facing surface 176 of the outer flange 142. The outer flange 142 provides a rearward stop for the locking member 124 limiting further rearward movement of the locking member 124. In the advanced position, a forward facing surface 178 of the inner flange 168 engages, or approximately engages, the shoulder 152 of the retainer 118. The shoulder 152 provides a forward stop for the locking member 124 limiting further forward movement of the locking member 124.

The actual final advanced position of the locking member 124 may be rearward of the shoulder 152, but the shoulder 152 defines a maximum advanced position. For example, the locking member 124 may be moved by a predetermined amount until the teeth 166 are properly aligned with the threaded area 22 of the jack connector 10. For example, the teeth 166 may be aligned with the valleys 26 between the ridges 24 of the threaded area 14. The locking member 124 tends to float longitudinally into the proper position (e.g. in alignment with the valleys 26) with respect to the threads 22.

In an exemplary embodiment, the body 12 is loaded into the receiving space 164 such that the teeth 160 are positioned further along the threaded area 14 than the first thread 30 and/or the second thread 34 prior to being snapped into place. Once properly aligned, the grasping arms 162 are deflected radially inward toward the jack connector 10 such that the teeth 166 are set in the valleys 26. When properly aligned, the inner flange 168 may not engage the shoulder 152, but rather may be spaced apart from the shoulder 152.

The collar 122 is used to lock the grasping arms 162 in place with respect to the jack connector 10. As the collar 122 is moved to the advanced position, the embossment 154 engages the gasping arms 162 and forces the grasping arms 162 against the jack connector 10. In an exemplary embodiment, each of the grasping arms 162 includes a ramp 180 that extends radially outward therefrom. As the collar 122 is moved to the advanced position, the embossment 154 engages each of the ramps 180 and forces the corresponding grasping arms 162 radially inward toward the jack connector 10. The teeth 166 are forced into the valleys 26 as the collar 122 is moved forward and as the embossment 154 rides along the ramps 180. As the collar 122 slides forward over the locking member 124, the collar 122 provides a radial compressive force onto the grasping arms 162. In the advanced position, the collar 122 blocks the grasping arms 162 from being deflected outward, which holds the teeth 166 in the valleys 26 and thus securely attaches the connector 100 to the jack connector 10.

In an exemplary embodiment, the locking member 124 includes a forward lip 182 and a rearward lip 184. The forward lip 182 extends radially outward from the tips of the grasping arms 162. The rearward lip 184 extends radially outward from the base 160. The forward and rearward lips 182, 184 cooperate to capture the collar 122 on the locking member 124. For example, the collar 122 is slidably coupled to the locking member 124 and has a range of motion with the forward and rearward lips 182, 184 defining forward and rearward stops. The collar 122 engages the rearward lip 184 when the collar 122 is in the retracted position. The collar 122 engages the forward lip 184 when the collar 122 is in the advanced position.

Figure 4:
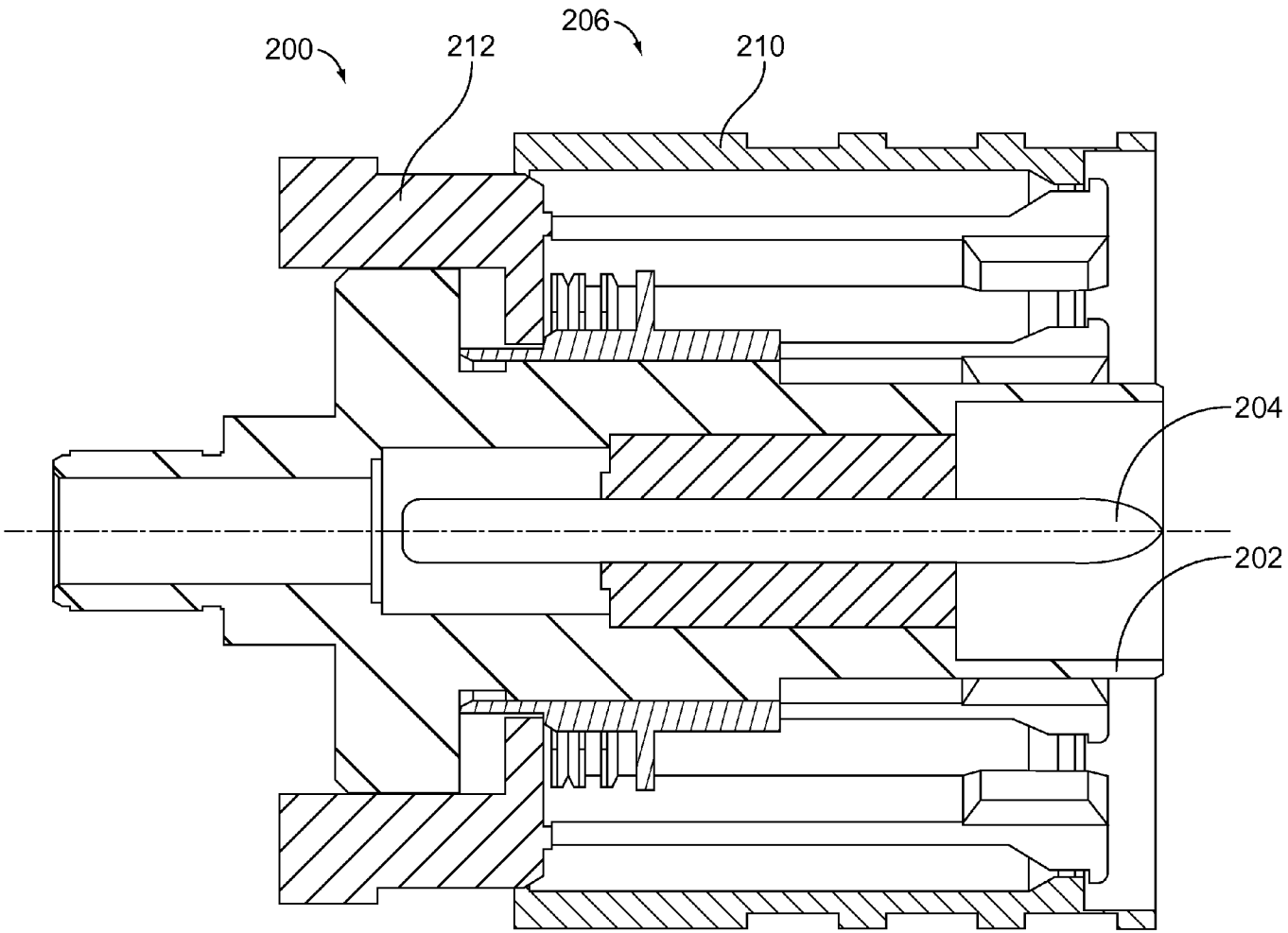
FIG. 4 is a cross-sectional side view of an alternative coaxial cable connector.

FIG. 4 is a cross-sectional side view of an alternative coaxial cable connector 200. The connector 200 is similar to the connector 100 (shown in FIG. 1), however the connector 200 includes a main body 202 that is a single piece, as opposed to the rear body 110 (shown in FIG. 1) and the front body 116 (shown in FIG. 1). The main body 202 defines an outer contact for the connector 200 that circumferentially surrounds a center pin contact 204.

The connector 200 includes a locking assembly 206 that is similar to the locking assembly 106 (shown in FIG. 1). The locking assembly 206 includes a collar 210 and a locking member 212. Both the collar 210 and the locking member 212 are independently movable with respect to the main body 202 and the center pin contact 204. For example, the locking member 212 is configured to be slidable along the body 202 in a longitudinal direction. Similarly, the collar 210 is configured to be slidable along the locking member 212 in a longitudinal direction. As such, the collar 210 is slidable with respect to the body 202 and the center pin contact 204 in the longitudinal direction. The locking assembly 206 is configured to be coupled to a mating connector in a similar manner as the locking assembly 106.

Figure 5:
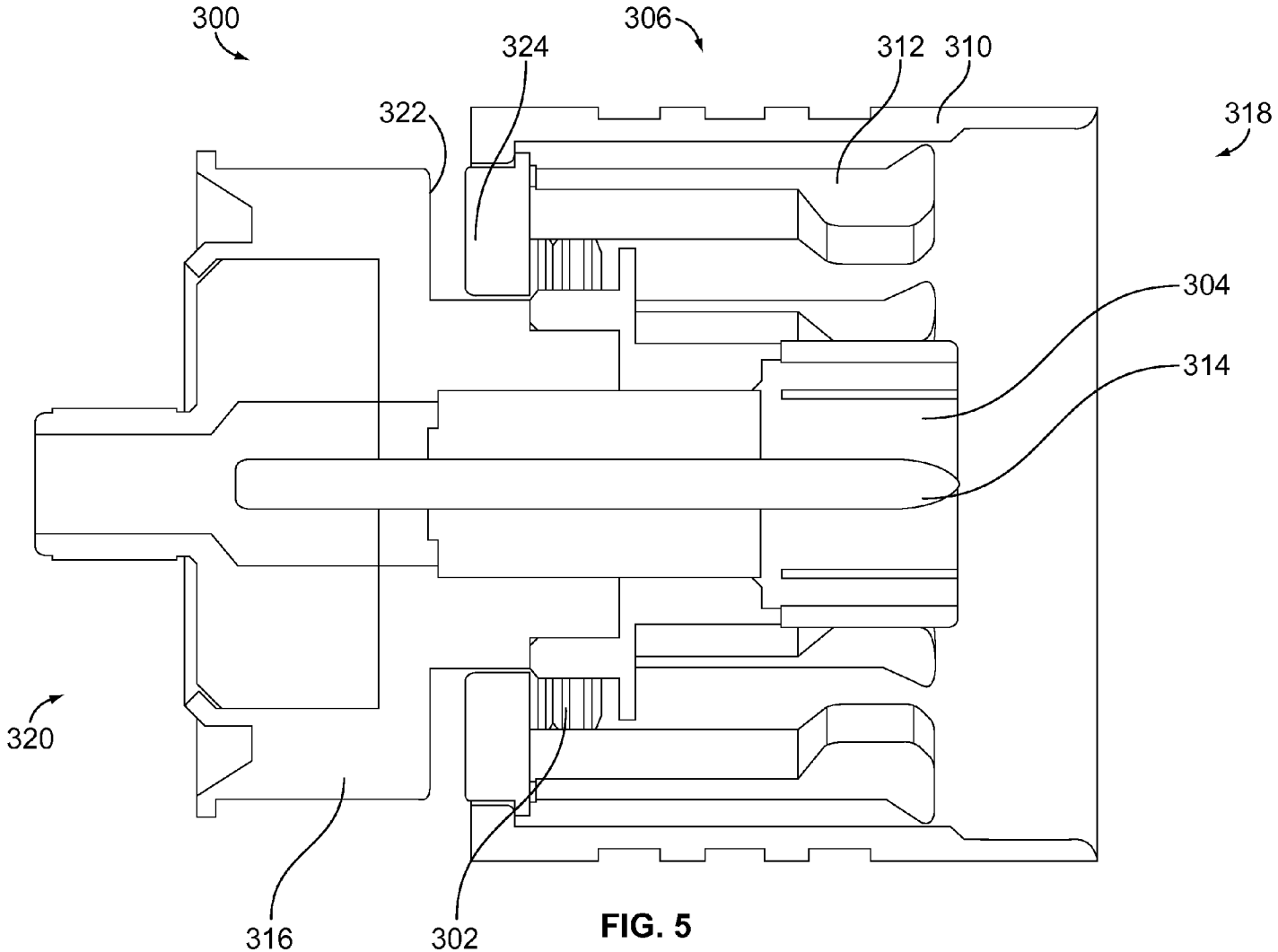
FIG. 5 is a cross-sectional side view of another alternative coaxial cable connector.

FIG. 5 is a cross-sectional side view of another alternative coaxial cable connector 300. The connector 300 is similar to the connector 100 (shown in FIG. 1), however the connector 300 does not include a retainer to hold a biasing member 302. Rather, the biasing member 302 is held by a front body 304.

The connector 300 includes a locking assembly 306 that is similar to the locking assembly 106 (shown in FIG. 1). The locking assembly 306 includes a collar 310 and a locking member 312. Both the collar 310 and the locking member 312 are independently movable with respect to the front body 304 and a center pin contact 314 that is held by the front body 304. For example, the locking member 312 is configured to be slidable along the front body 304 in a longitudinal direction. Similarly, the collar 310 is configured to be slidable along the locking member 312 in a longitudinal direction. As such, the collar 310 is slidable with respect to the body 304 and the center pin contact 314 in the longitudinal direction. The locking assembly 306 is configured to be coupled to a mating connector in a similar manner as the locking assembly 106.

The connector 300 includes a rear body 316 that is coupled to the front body 304. The front and rear bodies 304, 316 cooperate to define a main body of the connector 300. The main body is elongated in a longitudinal direction between a mating end 318 and a cable end 320. The front and rear bodies 304, 316 define a ground plane that circumferentially surrounds the center pin contact 314.

The rear body 316 includes an outer flange 322 extending radially outward and the locking member 312 includes an inner flange 324 extending radially inward.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A coaxial cable connector comprising:

an elongated body extending in a longitudinal direction between a mating end and a cable end;

a center contact held by the body;

a locking member circumferentially disposed around the body at the mating end, the locking member having teeth configured to mechanically engage a threaded area of a mating connector to securely attach the coaxial cable connector to the mating connector, the locking member being slidably coupled to the body such that the locking member moves with respect to the body along the longitudinal direction to enable the teeth to align with the threaded area of the mating connector along the longitudinal direction; and a retainer circumferentially disposed around the body, the retainer being positioned between the body and the locking member, the retainer having a shoulder, the locking member sliding forward until the locking member engages the shoulder.

2. The connector of claim 1, wherein the locking member is movable between a retracted position and an advanced position, the locking member moving linearly along the threaded area as the locking member is moved from the retracted position to the advanced position.

3. The connector of claim 1, wherein the center contact is fixed relative to the body, the locking member moving axially along the body and the center contact.

4. The connector of claim 1, wherein the body includes an outer flange extending radially outward, the locking member including an inner flange extending radially inward, the locking member being movable between a retracted position and an advanced position, the inner flange engaging the outer flange when in the retracted position, the inner flange being spaced apart from the outer flange when in the advanced position.

5. The connector of claim 1, further comprising a biasing member circumferentially disposed around the body, the biasing member engaging the locking member and providing a biasing force on the locking member urging the locking member away from the mating connector.

6. The connector of claim 1, wherein the locking member includes grasping arms having the teeth thereon and being configured to engage the mating connector, the connector further comprising a collar circumferentially disposed around the locking member, the collar slidably coupled to the locking member for engaging the grasping arms and applying a radial compressive force thereto for moving the grasping arms toward the mating connector.

7. The connector of claim 1, wherein the body defines a grounded outer contact circumferentially disposed around the center contact, the connector further comprising a dielectric between the body and the center contact.

8. The connector of claim 1, the retainer having a rim extending outward therefrom, the connector further comprising a biasing member disposed between the rim and the locking member, the biasing member providing a biasing force on the locking member urging the locking member away from the rim.

9. The connector of claim 1, wherein the locking member includes an opening therethrough, the body being received in the opening through the locking member, the locking member being slidable on the body.

10. A coaxial cable connector comprising:

an elongated body extending in a longitudinal direction between a mating end and a cable end;

a center contact held by the body;

a locking member circumferentially disposed around the body at the mating end, the locking member having grasping arms being configured to engage a threaded area of a mating connector, the locking member being slidably coupled to the body such that the locking member moves with respect to the body in the longitudinal direction to enable the grasping arms to be aligned with the threaded area of the mating connector;

a collar circumferentially disposed around the locking member, the collar being slidably coupled to the locking member and moving in the longitudinal direction, the collar engaging the grasping arms and applying a radial compressive force thereto for moving the grasping arms toward the mating connector; and a retainer circumferentially disposed around the body, the retainer being positioned between the body and the locking member the retainer having a shoulder the locking member sliding forward until the locking member engages the shoulder.

11. The connector of claim 10, wherein the locking member includes a forward lip and a rearward lip, the collar being slidable with respect to, and along, the locking member between the forward lip and the rearward lip.

12. The connector of claim 10, wherein the center contact is fixed relative to the body, the locking member moving axially along the body and the center contact.

13. The connector of claim 10, wherein the body includes an outer flange extending radially outward, the locking member including an inner flange extending radially inward, the locking member being movable between a retracted position and an advanced position, the inner flange engaging the outer flange when in the retracted position, the inner flange being spaced apart from the outer flange when in the advanced position.

14. The connector of claim 10, further comprising a biasing member circumferentially disposed around the body, the biasing member engaging the locking member and providing a biasing force on the locking member urging the locking member away from the mating connector.

15. The connector of claim 10, the retainer having a rim extending outward therefrom, the connector further comprising a biasing member disposed between the rim and the locking member, the biasing member providing a biasing force on the locking member urging the locking member away from the rim.

16. A coaxial cable connector comprising:

a center contact defining a signal plane along a contact axis;

a body circumferentially disposed around at least a portion of the center contact, the body defining a ground plane;

a locking member circumferentially disposed around the body, the locking member being configured to snap-on and engage a threaded area of a mating connector to securely attach the coaxial cable connector to the mating connector, the locking member being slidably coupled to the body such that the locking member moves with respect to the body in an axial direction parallel to the contact axis;

a biasing member circumferentially disposed around the body, the biasing member engaging the locking member and providing a biasing force on the locking member urging the locking member away from the mating connector in the axial direction; and a retainer circumferentially disposed around the body, the retainer being positioned between the body and the locking member, the retainer having a rim extending outward therefrom, the biasing member being disposed between the rim and the locking member and providing a biasing force on the locking member urging the locking member away from the rim.

17. The connector of claim 16, wherein the body includes an outer flange extending radially outward, the locking member including an inner flange extending radially inward, the locking member being movable between a retracted position and an advanced position, the inner flange engaging the outer flange when in the retracted position, the inner flange being spaced apart from the outer flange when in the advanced position.

18. The connector of claim 16, the retainer having a shoulder, the locking member sliding forward until the locking member engages the shoulder.

* * * * *